US005154337A

United States Patent [19]

Nick

[11] Patent Number: 5,154,337

[45] Date of Patent: Oct. 13, 1992

[54] FASTENING APPARATUS

[76] Inventor: Edward V. Nick, 512 Lexington Ave., Fox River Grove, Ill. 60021

[21] Appl. No.: 804,908

[22] Filed: Dec. 6, 1991

[51] Int. Cl.[5] ..... B21J 15/30

[52] U.S. Cl. ..... 227/27; 227/58; 408/241 R; 29/26 B

[58] Field of Search ..... 227/27, 58, 67; 7/158; 29/26 A, 26 B; 279/60; 408/20, 24, 241 R

[56] References Cited

U.S. PATENT DOCUMENTS

| | | | |
|---|---|---|---|
| 1,504,892 | 8/1924 | Jackson | 29/26 B |
| 2,553,924 | 5/1951 | Lillquist | 29/26 B |
| 3,850,254 | 11/1974 | Hirdes | 408/58 |
| 4,085,337 | 4/1978 | Moeller . | |
| 4,667,545 | 5/1987 | Gould, Jr. et al. . | |
| 4,674,367 | 6/1987 | Aab et al. . | |
| 4,813,122 | 3/1989 | Watanabe et al. | 29/26 A |
| 4,854,491 | 8/1989 | Stoewer | 227/58 |
| 4,919,321 | 4/1990 | Rydström et al. | 227/51 |

*Primary Examiner*—Frank T. Yost
*Assistant Examiner*—Scotta Smith
*Attorney, Agent, or Firm*—Godfrey & Kahn

[57] ABSTRACT

A fastening apparatus for installing a ribet which includes a hollow rivet body and a mandrel, the apparatus including, a means for imparting rotational movement to a drill bit; a housing borne by the rotation means and which includes an internal operating cavity, the housing operable to support the rivet; a driving assembly borne by the housing and disposed in force receiving relation relative to the drill bit; a locking assembly borne by the housing and operable to move along a predetermined path of travel from a first unlocked position to a second locked position; and a riveting assembly positioned in the internal cavity and disposed in force receiving relation relative to the locking assembly. During operation, the riveting assembly engages the mandrel of the rivet body when the locking assembly is positioned in the second locked position and wherein rotation of the drill bit causes the riveting assembly, in combination with the driving assembly, to forcibly withdraw the mandrel from the rivet body until the mandrel separates from the rivet body, thereby completing the riveting process.

17 Claims, 6 Drawing Sheets

FASTENING APPARATUS

1. FIELD OF THE INVENTION

The present invention relates generally to a fastening apparatus for installing rivets, and more particularly, to an apparatus which is releasably mounted on a drill assembly and which facilitates the installation of blind, or so called "pop" rivets into a work piece.

2. DESCRIPTION OF THE PRIOR ART

Various fasteners have been developed heretofore to join together or otherwise fasten assorted work pieces, one to the other. A form of fastener that has enabled both a consumer and an industrial worker to fasten two juxtaposed planar members together is the rivet.

As a general matter, rivets are typically utilized for joining and fastening together metal and other materials, such as all manner of plastics and cloth when brazing, welding or other fastening techniques would not be suitable or would not provide a satisfactory joint. As should be understood, rivets are generally classified as either standard rivets or blind, so called "pop" rivets. In this regard, a standard rivet includes a shank portion which is received through an aperture which is drilled, or otherwise formed in the respective materials that are to be fastened or joined together, and when struck with a rivet hammer, the shank is flattened into a mushroom-like head which inhibits or otherwise restrains the materials from separating. In contrast, blind, or "pop" rivets have a self-heading capability, that is, they may be installed where it is impossible to use a rivet hammer as described above. A typical pop-rivet includes a hollow rivet body having a flange portion, and a mandrel which includes an enlarged or bulbous head portion and a distal stem portion.

Utilization of pop-rivets provides at least two noteworthy advantages over standard rivets. First, and most importantly, pop-rivets can typically be installed by one person utilizing a single hand. Secondly, pop rivets can be employed for blind fastening, that is, they can be utilized in those environments where there is limited access, or no access, to the reverse side of the surfaces which are being joined together. For example, pop-rivets have been extensively utilized in the installation of roof gutters, joining metal flue pipes together, and assembling sections of exhaust pipes for clothes dryers. Pop-rivets are also extensively used throughout modern industry for other purposes, such as in clothes construction and the like.

Heretofore, prior art pop-rivet fastening tools have included two general categories of mechanical design. Pop-rivet fastening tools of the first design are manipulated by hand, and require a user to perform four steps to apply one pop-rivet. In the first step, a drill is generally utilized to form an appropriately dimensioned aperture in the individual work pieces which are to be joined. The second step includes inserting the distal stem portion of the mandrel into the pop-rivet tool. In the third step, the bulbous head portion of the pop-rivet is inserted through the aperture which has been formed in the work pieces which are to be fastened together. Finally, and in the fourth step, manual force is exerted on the tool causing it to withdraw the stem of the pop-rivet. This manual force causes a portion of the hollow rivet body to be deformed in a fashion whereby the outside diametral dimension of the deformed portion exceeds the diametral dimension of the aperture. As force is continued to be applied, the deformed portion of the hollow rivet body becomes generally parallel to the flange portion. Continued force applied to the stem increases pressure in the opposite direction against the flange which ultimately results in the stem breaking or separating from the pop-rivet with a "pop" like noise. As a result of this operation, there is formed a generally interior facing flanged member which overlies the inner work piece as the flange portion of the pop-rivet body overlies the outer work piece.

A second design category for these same assemblies includes various multi-functional devices which perform several different functions, or which alternatively remedy some inefficiencies created by standard riveting processes. An example of such a prior art device is found in U.S. Pat. No. 4,085,337.

Foremost among the noteworthy deficiencies of the prior art pop-rivet fastening tools of the first design type is their relative inability to reduce the number of operational steps which must be sequentially employed to complete a riveting operation. More particularly, a consumer or artisan who is fastening work pieces together with this first design type of pop-riveting tool is continuously required to alternate between the pop-riveting tool and a power drill throughout the riveting operation. This, of course, results in costly delays in manufacturing process, worker frustration, and fatigue.

Moreover, the second design category has several shortcomings. For example, one of the deficiencies of the prior art pop-riveting tools of the second design category is that they are inherently heavy and cumbersome to employ in most non-industrial and commercial environments. Furthermore, these same devices require that the worker or homeowner often employ the fastening tool at arms length away from his body, or her body, or in some cases directly above his or her head, for significant periods of time. Therefore, the weight and cumbersome characteristics of these second design type prior art fastening tools reduces the efficiency of a worker by causing great fatigue.

Yet another deficiency of the pop-riveting tools of the first design type is their apparent inability to perform multiple functions during use. More particularly, these prior art pop-rivet tools are operable, generally speaking, only to install pop-rivets into a work surface. Pop-rivet tools of this design are not operable to perform additional functions, such as, for example, drilling or forming apertures in work surfaces. In view of this shortcoming, workers heretofore, have employed several tools to perform essentially similar tasks. This, of course, multiplies the task and thereby reduces the efficiency of the manufacturing process. Further, fastening tools of this first design type are much more hazardous to employ while working high above the ground such as on scaffolding or ladders when employing the device to install rain gutters, chimney assemblies, or the like because of the ever-present need for the artisan or homeowner to maintain their balance on the ladder or scaffold while switching tools.

Yet another deficiency of the riveting tools of the first design type results from characteristics inherent in their design, for example, a worker or homeowner must typically squeeze the pop-riveting tool perhaps hundreds of times during a typical work shift, or during the installation of a rain gutter assembly or chimney assembly, for example. This, of course, increases fatigue when employing the device.

Still another deficiency attendant with the prior art tools of the second design is their complexity. More particularly, these pop-riveting tools are extremely complex in operation. This complexity of design, as should be understood, increases the likelihood that these same tools will malfunction during operation under typical industrial conditions which are often dusty, or conducted in a manner where debris generated from work object comes into immediate contact with this pop-riveting tool. Further, and as should be readily apparent, the complex design of these pop-riveting tools increases the manufacturing costs for these same tools, and often puts them out of the reach of the homeowner, for example.

Therefore, it has long been known that it would be desirable to have a fastening apparatus for rapidly installing pop-rivets, and which is particularly well suited for efficient operation, and which is further operable to permit the user thereof to install a pop-rivet into an object of interest without requiring the user to utilize additional tools for completing the same operation, and wherein the fastening apparatus would be lightweight and maneuverable, and which also may be powered by a power drill.

3. OBJECTS AND SUMMARY OF THE INVENTION

Therefore, it is an object of the present invention to provide an improved fastening apparatus for installing pop-rivets.

Another object of the present invention is to provide such an apparatus which is operable to obtain the individual benefits to be derived from related prior art apparatuses and practices while avoiding the detriments individually associated therewith.

Another object of the present invention is to provide such an apparatus which is operable to facilitate the rapid installation of pop-rivets into an object of interest.

Another object of the present invention is to provide such an apparatus that is light-weight and maneuverable to reduce user fatigue.

Another object of the present invention is to provide such an apparatus which is operable to perform multiple functions.

Another object of the present invention is to provide such an apparatus which is of relatively moderate cost to produce, purchase, and maintain, and which further is inexpensive to operate.

Another object of the present invention is to provide such an apparatus which is characterized by ease of employment, and simplicity of construction.

Another object of the present invention is to provide such an apparatus which utilizes a power tool, such as an electric drill, both to drill or form an aperture in a work piece and to provide the motive force necessary to install a pop-rivet.

Further objects and advantages of the present invention are to provide improved elements and arrangements thereof in an apparatus for the purposes described, and which is dependable, economical, durable and fully effective in establishing its intended purposes.

These and other objects and advantages are achieved in an apparatus for installing pop-rivets into a work piece, the apparatus having a drill for forming an aperture into the work piece and wherein the drill includes a rotatable drill bit; a housing which is releasably borne by the drill, and which includes an internal operating cavity; a driving assembly which is borne by the housing and which is reciprocally movable relative thereto, and wherein the driving assembly is engaged by the drill means; a rivet support assembly which is borne by the housing; a locking assembly which is borne by the housing and which is operable to move along a predetermined path of travel from a first unlocked position into a second locked position; and a riveting assembly which is borne by the housing and which is urged into engagement with the rivet by way of the locking assembly.

4. BRIEF DESCRIPTION OF THE DRAWING

DETAILED DESCRIPTION OF THE PREFERRED EMBODIMENT

Figure 1:
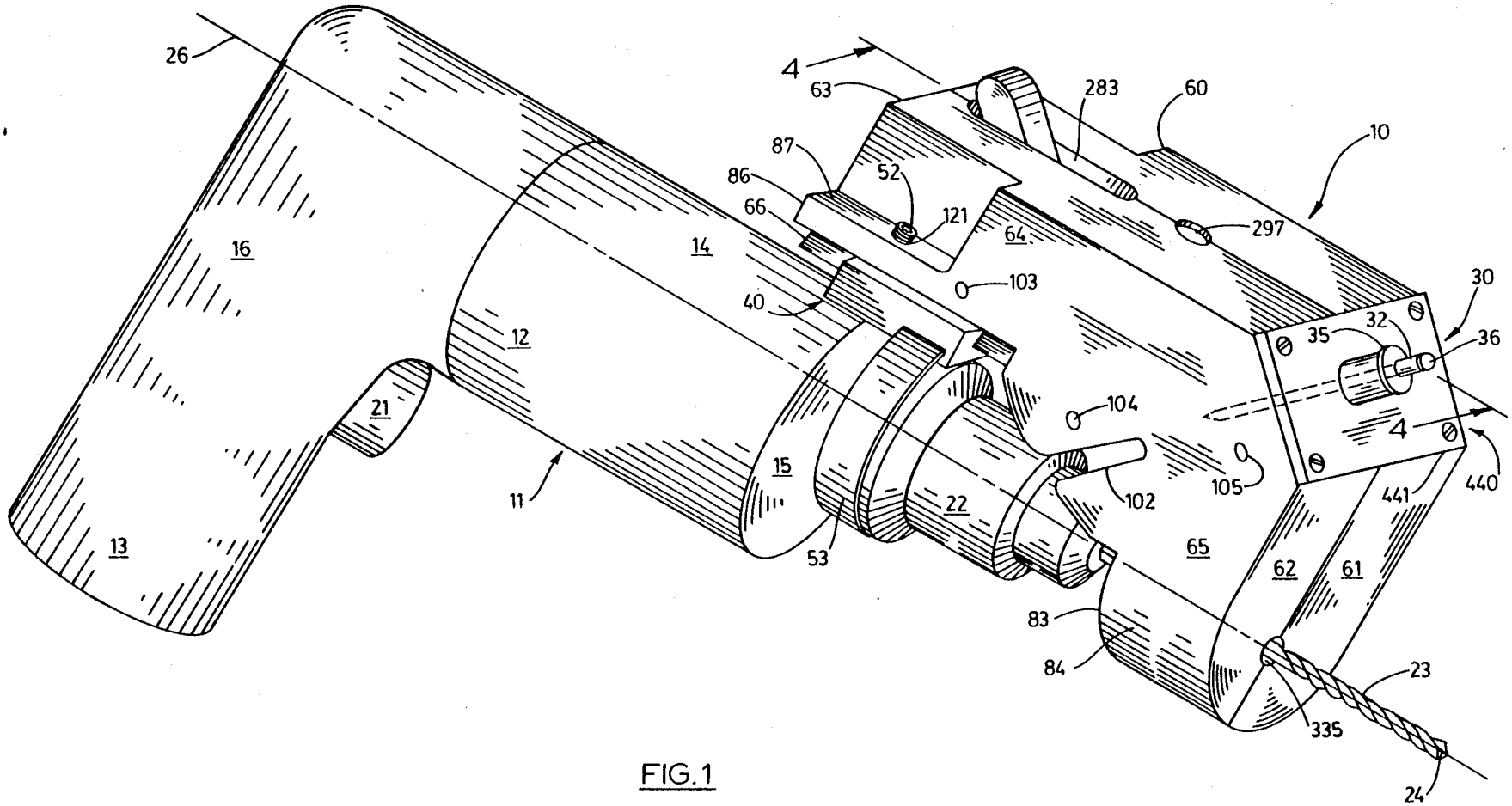
FIG. 1 is a right, perspective, environmental view of the apparatus of the subject invention shown in a typical operative configuration and wherein it is mounted on a portable power drill.
Figure 2:
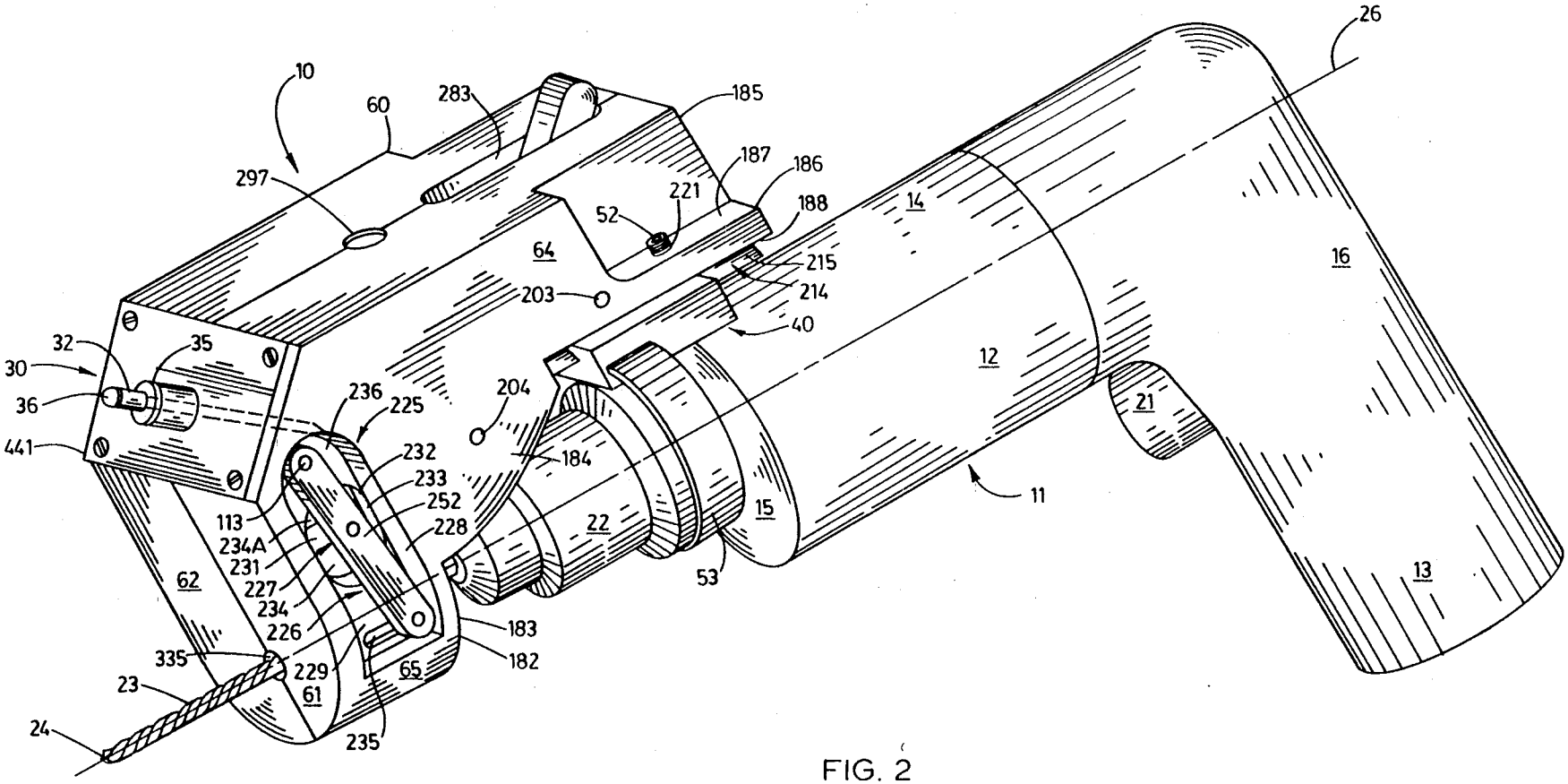
FIG. 2 is a left, perspective, environmental view of the apparatus of the subject invention shown in a typical operative configuration and wherein it is mounted on a portable power drill.
Figure 3:
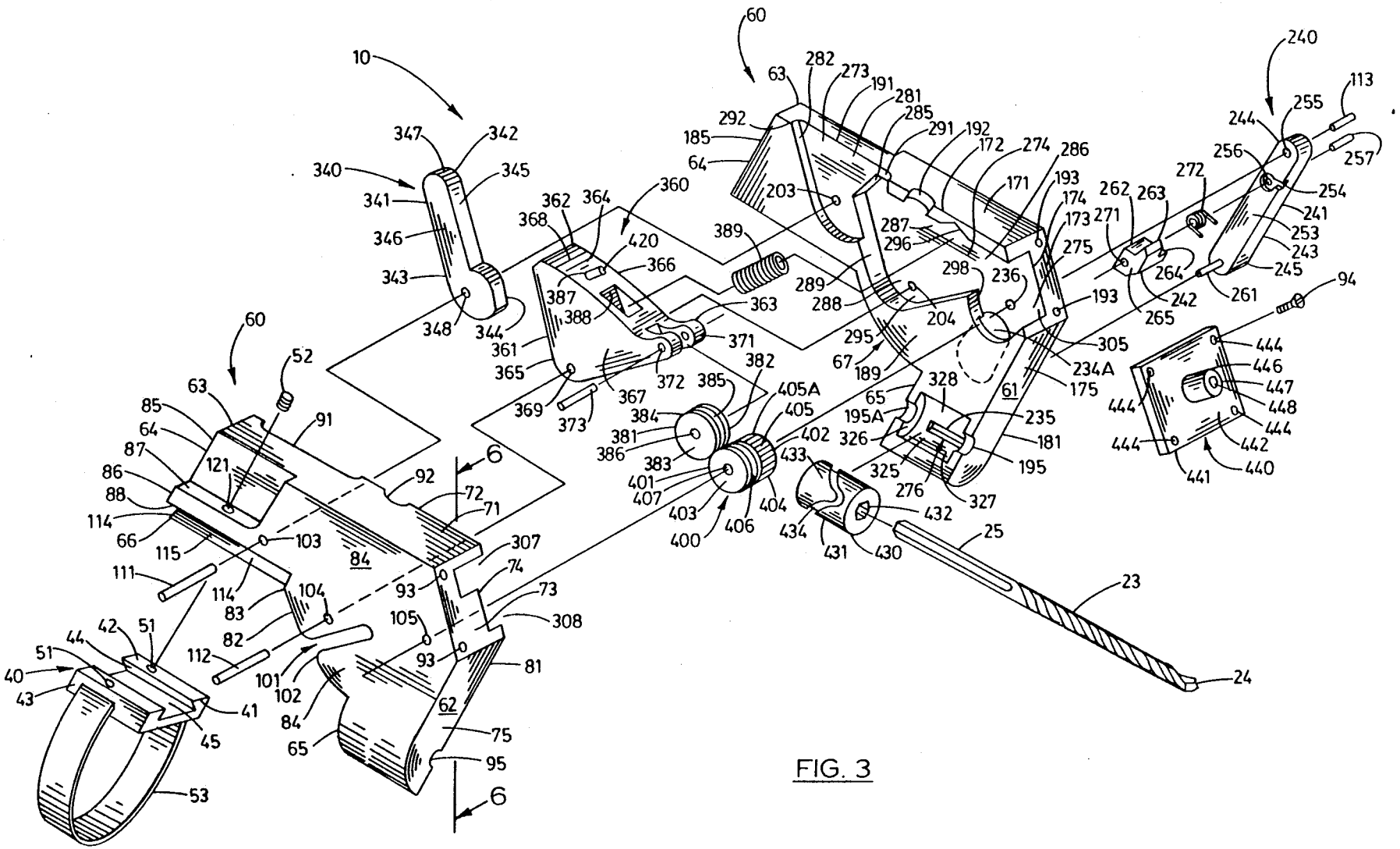
FIG. 3 is a perspective, exploded view of the apparatus of the subject invention shown in FIG. 1.

Referring more particularly to the drawings, the apparatus of the subject invention is generally indicated by the numeral 10 in FIGS. 1, 2 and 3. As shown therein, the apparatus 10 is utilized in combination with a power drill 11 which is of conventional design. It should be understood that the power drill may be an electric drill or alternatively, it may be a drill which is driven by other sources of power, such as pressurized air, and the like. The drill 11 has a housing 12 which has affixed thereto a handle 13. The housing has a top surface 14, a forwardly facing portion 15 and an opposite, rearwardly facing portion 16. Further, a movable trigger 21 is mounted on the handle 13 and is operable to actuate the drill. As best seen in FIGS. 1 and 2, a rotatable chuck 22 is borne by the housing and is connected in driving relation relative to a motor, not shown, and which is enclosed in the housing. The chuck is of conventional design and is operable to receive, and secure, a bit 23 for rotational movement therewith. The bit, which is also of conventional design, has a work surface engaging portion 24, and an opposite shaft portion 25 which is generally hexagonal in its cross-sectional shape and which is defined by a plurality of surfaces. The drill is operable to rotate the bit in both the clockwise and counterclockwise directions as operational requirements dictate. The bit is substantially coaxially aligned with a first longitudinal line of reference which is indicated by the line labeled 26.

Figure 5:
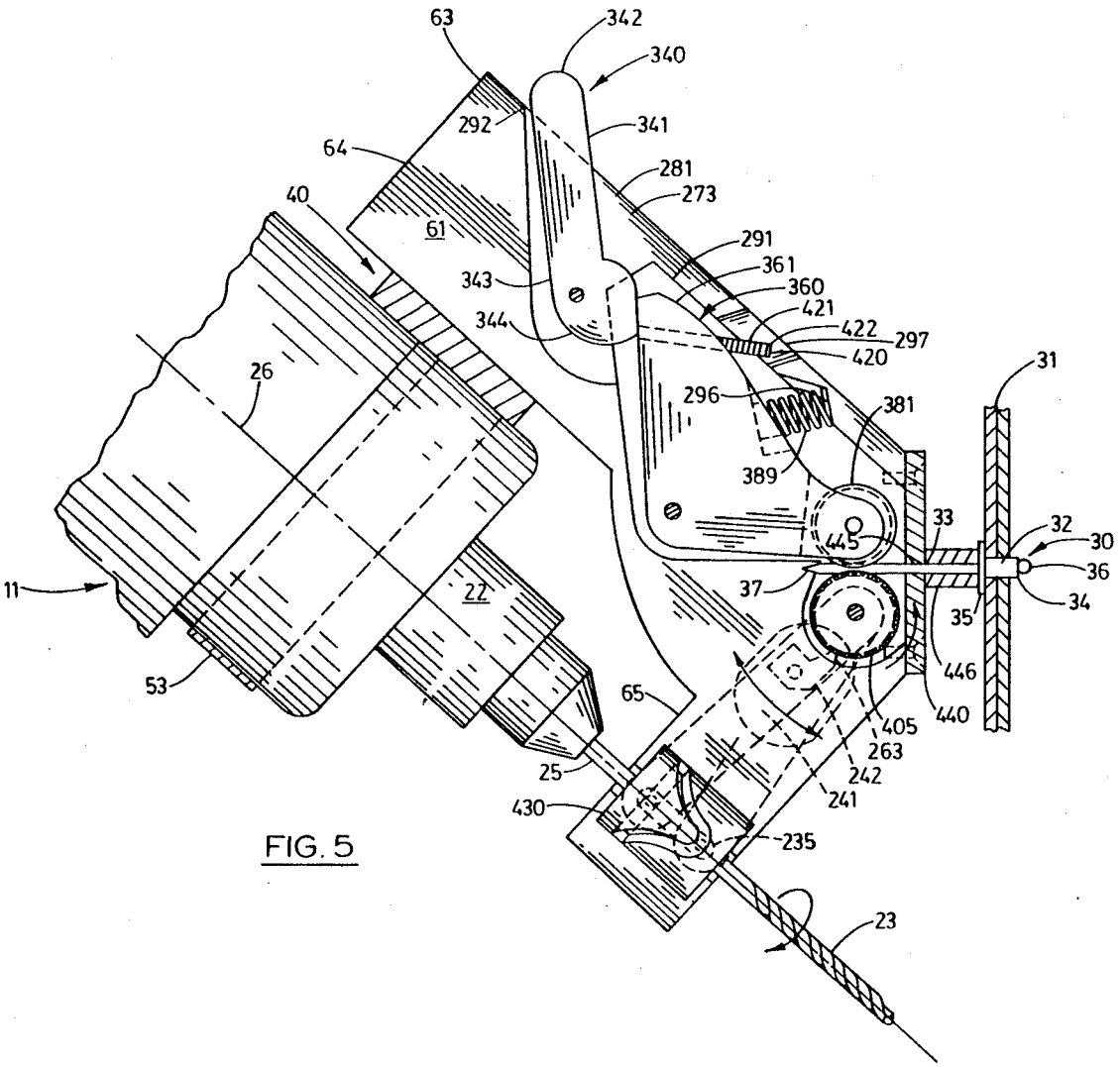
FIG. 5 is a left fragmentary, longitudinal, vertical, sectional view taken from a position along line 4—4 of FIG. 1, and which illustrates the apparatus of the present invention being employed to install a pop-rivet.

As best seen by reference to FIGS. 1, 2 and 5, the apparatus 10 of the subject invention is operable to utilize a rivet 30 to fasten or join together two juxtapositioned members 31. The rivet 30, as shown herein, is classified as a pop-rivet or blind rivet, and is of conventional design having a hollow rivet body 32 and a mandrel 33. As should be understood, the hollow rivet body includes a collar portion 34 and a flange 35. Further, the mandrel includes a bulbous head portion 36 and a stem portion 37. Individual rivets are supported on the apparatus 10 during the riveting process. As earlier discussed, the apparatus is useful for fastening or joining together juxtapositioned members 31 which may include roof gutters, metal flew pipes, metal exhaust pipes, cloth, synthetic materials and the like.

As best illustrated by reference to FIGS. 1, 2 and 3, the apparatus 10 of the subject invention is removably mounted on the drill 11 by a mounting assembly which is generally indicated by the numeral 40. The mounting assembly includes a mounting bracket 41 which has a generally U-shaped main body 42, and which is defined by an exterior facing surface 43, and an interior facing surface 44. In the preferred embodiment, the interior facing surface defines a substantially dovetail or truncate shaped channel 45, which has predetermined longitudinal and transverse dimensions. The exterior facing surface 43 of the U-shaped main body has formed therein a pair of threaded apertures 51 which are individually operable to matingly engage individual threaded fasteners 52. The operation of the channel 45, the threaded bores 51, and the threaded fasteners 52 will be explained in further detail in the paragraphs which follow. It should be understood that the mounting bracket 41 is secured on the housing 12 of the drill by conventional fastening techniques, that is, the bracket may be formed integrally with the housing as by molding or the like, or further, fasteners may secure the main body of the mounting bracket to the housing of the drill. Further, and as best seen by reference to FIG. 3, the mounting bracket may be releasably mounted on the drill. In this embodiment, a mounting or support strap 53 is attached on the exterior surface 43 of the U-shaped main body and is operable to encircle same. An adjustment mechanism, (not shown) is adapted to tighten the strap about the housing of the drill. In this fashion, an artisan may release the apparatus 10 and the associated mounting bracket from the drill in the event the apparatus is not required.

As best seen by reference to FIGS. 1, 2, 3 and 6, the apparatus 10 has a housing 60 which includes a left half 61 and a right half 62. As a general matter, the left and right halves have overall shapes which are substantially mirror images of each other, that is, each has a substantially L-shaped main body 63 which includes a substantially rectangular shaped first portion 64 and a second portion 65 which is generally oriented substantially transversely or normal relative thereto. When assembled, and as best seen by reference to FIG. 3, the housing 60 further defines a generally truncated shaped mounting tenon 66, and an internal operating portion 67 which includes a plurality of cavities. The internal operating portion 67 and the mounting tenon 66 will both be described in further detail in the paragraphs to follow.

As best understood by a study of FIGS. 1, 2 and 3, and as noted above, the left and right halves 61 and 62, respectively, of the housing 60 have generally similar overall shapes, however, the exterior surfaces of same are somewhat different as will be discussed below. Further, and except where noted, it should be understood that the internal cavities are substantially identical, one to the other. Also, and to assist in understanding the present invention, it should be understood that all apertures, or other bores, either threaded or smooth, unless indicated to the contrary, are generally oriented substantially perpendicular relative to the supporting surfaces in which they are formed.

Figure 6:
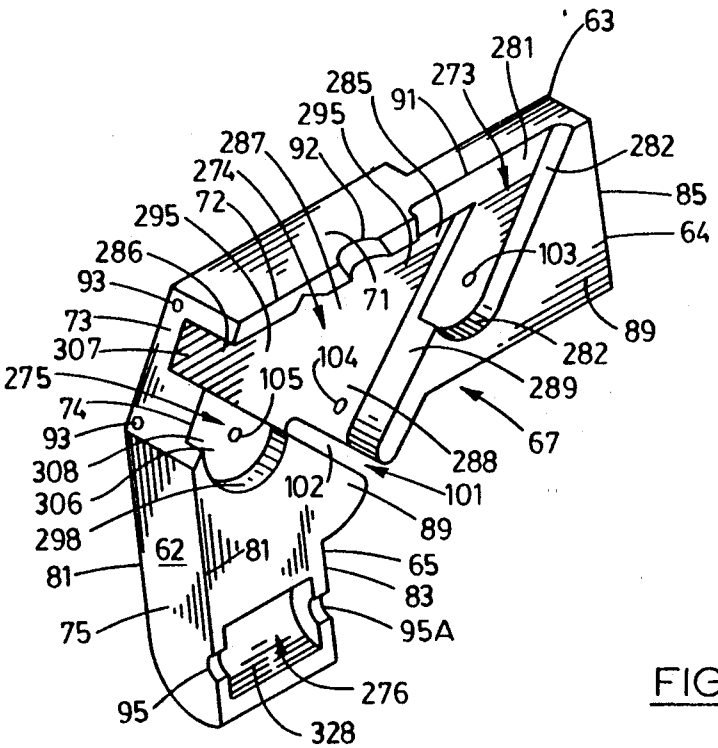
FIG. 6 is a left perspective view of the right housing portion of the apparatus of the subject invention.

As illustrated in FIGS. 1, 3 and 6, the right half 62 of the housing 60 has a top surface 71 which is defined by a peripheral edge 72. Further, the right half includes an angularly disposed and forwardly facing surface 73 which is defined by a peripheral edge 74, a front exterior surface 75 which is defined by a peripheral edge 81; a bottom surface 82; which is defined by a peripheral edge 83; an exterior facing or outwardly disposed side wall 84 and a rear wall 85. The side wall 84 is oriented generally perpendicular to the top surface 71. Further, and formed within the side wall 84, of the first portion 64, is a ledge portion 86 which is defined by the rear wall 85, the side wall 84, a top exterior surface 87, and an opposite, bottom exterior surface 88. The main body 63 of the right half 62 further has an interior or inside facing surface 89 which defines the internal operating cavity or portion 67.

As best understood by reference to FIGS. 1, 3 and 6, the peripheral edge 72 of the top surface 71 of the right housing 62 defines a first substantially elongated aperture 91 and a second substantially semicircular shaped aperture 92. Further, the angularly disposed surface 73 has formed therein a pair of threaded apertures 93 which are individually operable to matingly engage suitable threaded fasteners 94. The peripheral edges 81 and 83 form substantially semicircular shaped apertures 95 and 95A, respectively, and which have individual predetermined dimensions. When the housing 60 is assembled, the apertures 95 and 95A are operable to slidably receive the drill bit 23. A substantially elongated shaped mandrel ejection slot 101, and which is defined by a peripheral edge 102, is formed in the side wall 84 of the right housing portion 62. Although this mandrel ejection slot will be described in further detail hereinafter, it should be understood that this slot permits the rivet mandrels 33, which have been separated from the pop-rivet 30, to exit from the internal operating portion or cavity 67 of the apparatus 10 under the influence of gravity. In addition to the foregoing, three apertures 103, 104, and 105, respectively, are formed in the exterior side wall 84. The individual apertures 103, 104, and 105 are operable to matingly receive suitable fasteners or pins 111, 112, and 113, respectively. Further, the bottom surface 82 defines the right half 114, of the mounting tenon 66. The right half of the tenon is defined by the peripheral edge 83, and an exterior tenon surface 115. Further, the ledge portion 86 has formed therein, a threaded aperture 121 which is operable to threadably mate with the threaded fastener 52. The fastener 52 also threadably engages the threaded aperture 51. The operation of mounting tenon 66 will be described in further detail hereinafter.

As best illustrated in FIGS. 2 and 3, the left half 61 of the housing 60 has a top surface 171 which is defined a peripheral edge 172. Further, the left half of the housing includes an angularly disposed and forwardly facing surface 173 which is defined a peripheral edge 174. A front exterior surface 175 is defined by a peripheral edge 181. Additionally, a bottom surface 182 is defined by a peripheral edge 183. The housing additionally has an exterior facing, or outwardly disposed side wall 184, and a rear facing wall 185. The side wall 184 is oriented generally perpendicular to the top surface 171. Further, and formed within the side wall 184 of the first portion 64 is a ledge portion 186 which is defined by the rear wall 185, the side wall-184, a top exterior surface 187, and an opposite bottom exterior surface 188. The main body 63 of the left half 61 further has an interior or inside facing surface 189 which defines the internal operating portion 67.

As best seen by reference to FIGS. 2 and 3, the peripheral edge 172, of the top surface 171, of the left housing 61 defines a first substantially elongated aperture 191 and a second substantially semicircular shaped aperture 192. Further, the angularly disposed surface 173 has formed therein a pair of threaded apertures 193 which are individually operable to matingly engage the threaded fasteners 94. Further, the peripheral edges 181 and 183 form substantially semicircular shaped apertures 195 and 195A, respectively. Each of the apertures have predetermined dimensions. As earlier discussed, and when the housing is assembled, the apertures are operable to slidably receive the drill bit 23. In addition to the foregoing, two apertures 203 and 204, respectively, are formed in the exterior side wall 184. The apertures 203 and 204 are operable to matingly receive, or accommodate, the mounting pins 111 and 112, respectively. Further, the bottom surface 182 includes the left half 214 of the mounting tenon 66. The left half of the tenon is defined by the peripheral edge 183 and an exterior tenon surface 215. Further, the ledge portion 186 has a threaded aperture 221 formed therein and which is operable to matingly receive the threaded fastener 52. It should be understood that when the left half 61 and the right half 62 are assembled to form the housing 60, the left tenon half 214 and the right tenon half 114 form the substantially truncate shaped mounting tenon 66. The mounting tenon 66, which has a dovetail-like shape, is defined by the left exterior tenon surface 215 and the right exterior tenon surface 115, respectively, and is conformably dimensioned to slidably engage or be received in the dovetail shaped channel 45. As should be understood, the dimensions of the dovetail shaped channel 45 are just slightly greater than the dimensions of the dovetail shaped mounting tenon 66. This dimensional relationship between the channel and the tenon permits the channel to slidably receive and closely hold the tenon 66. As discussed above, the threaded fasteners 52 are operable to screw threadably engage the threaded apertures 121 and 221 of the respective ledge portions, and the respective threaded apertures 51 of the mounting bracket 41 thereby fixedly locating the apparatus 10 upon the power drill 11.

As best understood by a study of FIG. 2, the exterior facing side wall 184 has a drive cavity formed therein and which is generally indicated by the numeral 225. The drive cavity 225 includes an outer drive cavity portion 226 and an inner drive cavity portion 227. The outer drive cavity portion is defined by an interior facing wall or surface 228, and a substantially planar bottom surface 229. The bottom surface 229 has formed therein an aperture 231 which is defined by a peripheral edge 232, and which creates a passageway from the outer drive cavity portion to the inner drive cavity portion. The inner drive cavity portion 227 is defined by an interior wall or surface 233, and a substantially planar bottom surface 234. As should be understood, the inner drive cavity portion 227 communicates with the internal operating cavity or portion 67 by way of the aperture 234A. Further, the planar bottom surface 229 of the outer drive cavity portion has formed therein a substantially elongated slot 235 which communicates with the internal operating cavity or portion 67, and an aperture 236 which is operable to receive the pin 113. The significance of the elongated slot 235 will be discussed hereinafter.

As best understood by a study of FIGS. 2 and 3, the apparatus 10 of the subject invention has a drive assembly which is generally indicated by the numeral 240 and which is positioned in the drive cavity 225. More particularly, the drive assembly includes a drive arm 241 and a pawl 242. The drive arm 241 has a main body 243 which includes a first end 244 and an opposite second end 245. The main body 243 further includes a left lateral surface 252 and an opposite right lateral surface 253. Formed in the right lateral surface 253 is a depression or spring receiving station 254. Further, the first end 244 of the drive arm has formed therein a pair of bores 255 and 256, and which are operable to receive the pins 113 and 257, respectively. As illustrated in FIG. 3, the second end 245 of the drive arm mounts a post or actuator 261 which extends generally normally outwardly relative thereto, and which is slidably received in the elongated slot 235. It should be understood that in operation, the post or actuator 261 moves in a reciprocal fashion in the elongated slot 235. This reciprocal motion causes the drive arm 241 to pivot about the pin 113.

Unlike the drive arm 241 which is operable for movement in the outer drive cavity portion 226, the pawl 242 is reciprocally moveable within the inner drive cavity portion 227. The pawl 242 is defined by a main body 262 which has predetermined dimensions and which has formed therein at least one tooth 263 which sequentially engages the notches or interdental spaces which are formed in a drive wheel, so as to induce rotational motion of the drive wheel in a predetermined direction. The drive wheel will be discussed hereinafter. The main body further includes a left lateral surface 264, and a right lateral surface 265. Formed through the left and right lateral surfaces of the pawl is a bore 271. As best seen by reference to FIG. 3, the pin 257 pivotally mounts the pawl 242 on the drive arm 241. More particularly, the pin 257 is sequentially inserted through the bore 256, is received through a torsion spring 272 and is thereafter received in the bore 271 of the pawl. The spring is operable to be received in the spring receiving station and otherwise acts upon the pawl to bias it in a predetermined direction or otherwise hold the pawl in a predetermined position or attitude relative to the drive arm. Having described the drive assembly 240, it should be understood that reciprocal motion imparted to the drive arm 241 is operable to reciprocally move the pawl 242 along a predetermined path of travel within the inner drive cavity portion 227. In particular, and when assembled, and as best imagined by a study of FIG. 3 and 4, the tooth extends through the aperture 234A and into the internal operating portion or cavity 67.

A comparative study of FIGS. 3 and 6 reveals that the inside facing surfaces 89 and 189 of the right and left housing portions 62 and 61, respectively, define a plurality of cavities which are operable to enclose and support for movement a multiplicity of assemblies which will be discussed in greater detail hereinafter. As earlier discussed, the left half 61 of the housing 60, and more particularly, the internal cavities thereof, are substantially identical to the right half 62 of the housing, except as will hereinafter be specifically noted, and therefore for purposes of brevity, only the cavities shown in the left half 61 of the housing will be discussed in specific detail. The plurality of cavities include, generally speaking, a locking lever cavity 273; a riveting cavity 274; a drive wheel cavity 275; and a spindle cavity 276. The particular details of each of these cavities are discussed below.

As best seen in FIG. 3, the locking lever cavity 273 is positioned in the first portion 64 of the housing 60 and in a location generally rearwardly of, and in communication with, the riveting cavity 274. The locking lever cavity has predetermined length and width dimensions and is defined by a substantially planar surface 281 and a narrow side wall 282. As best seen by reference to FIGS. 1 and 2, and when assembled, the left and right halves of the housing, and more particularly the apertures 191 and 91 thereof, are positioned in spaced relation one to the other thereby defining a substantially elongated slot 283. As earlier discussed, the threaded aperture 203 which is formed in the surface 281, is operable to receive the pin 111. The locking assembly, which is mounted within the locking lever cavity by the pin 111, extends through the elongated slot 283. In addition to the foregoing, the locking lever cavity is further defined by a first end 291 and a second end 292. The locking assembly will be discussed in further detail hereinafter.

The riveting cavity 274 is positioned in a location forward of the locking lever cavity 273, and is further disposed in communication therewith. The riveting cavity 274 includes a first end 285, a second end 286, a top portion 287, and a bottom portion 288. Further, the riveting cavity has predetermined length and width dimensions and is defined by a narrow wall 289 and a substantially planar surface 295. As should be understood by a comparison of the surfaces 295 and 281, the surface 295 is positioned at a greater depth, or generally interiorly relative to the surface 281 of the housing 60. The riveting assembly is pivotally mounted within the riveting cavity by the pin 112. Further, the riveting assembly mechanically communicates with the locking lever assembly at the first end 285 of the riveting cavity. As should be understood by reference to FIG. 3, the wall 289 of the top portion 287 has formed therein the aperture 192, and a depression or cavity 296. The significance of these features, as well as the riveting assembly will be described in further detail hereinafter. As best seen by reference to FIGS. 1 and 2, and when assembled, the left and right halves of the housing, and more particularly, the apertures 192 and 92 thereof are positioned in alignment, or in registery one to the other thereby defining a substantially circular aperture 297.

As best seen by reference to FIG. 3, the drive wheel cavity 275 is positioned in a location forward of the riveting cavity 274 and is further disposed in mechanical communication therewith. A comparative study of FIGS. 3 and 6, will reveal that the drive wheel cavity 275 of the left housing half 61 is substantially different in shape and design from the drive wheel cavity of the right housing half 62, and therefore, the drive wheel cavity for each half of the housing 60 are individually described below. As best illustrated by reference to FIGS. 2 and 3, the drive wheel cavity for the left half of the housing is defined by the peripheral edge 174, the substantially curved wall or surface 298 and the planar surface 295. Moreover, the drive wheel cavity is disposed in mechanical communication with the inner drive cavity portion 227. More particularly, the curved wall or surface 298 and the planar surface 295 are positioned in space relation, one to the other, thereby defining the gap or passageway 234A through which the pawl 242 is received. Also, the peripheral edge 174 defines an aperture or passageway 305 which permits the stem portion 37 of the rivet mandrel 33 to extend therethrough and into the riveting cavity 274 and the drive wheel cavity 275, respectively. This is best seen by reference to FIGS. 4 and 5.

As best illustrated by reference to FIG. 6, the drive wheel cavity of the right half of the housing is defined by the peripheral edge 74, the substantially curved wall or surface 298 and the substantially planar surface 306. As should be understood and unlike the drive cavity of the left half of the housing, the surface 306 is not coplanar with the surface 295. In addition to the foregoing, the peripheral edge 74 of the right housing defines two discreet apertures or passageways, namely a first aperture 307 and a second aperture 308. As should be understood, and when assembled, the first aperture 307 permits the stem portion 37 of the rivet mandrel 33 to extend therethrough, and into the riveting cavity 274, and the drive wheel cavity 275. The significance of the second aperture will become more apparent hereinafter.

As best seen by reference to FIGS. 3 and 6, the spindle cavity 276 is formed, or otherwise disposed in a position within the second portion 65 of the housing 60. The spindle cavity is defined by a spindle support structure 325 which includes opposite first and second walls, or interior facing surfaces 326 and 327, respectively, and is further defined by a substantially arcuately or semicircular shaped surface 328. As best illustrated in FIGS. 2 and 3, the elongated slot 235 extends through the surface 328 of the spindle cavity formed in the left half of the housing 61 thereby establishing communication between the drive arm 241 and the spindle cavity. As best seen by reference to FIGS. 1 and 2, and when assembled, the left and right halves of the housing, and more particularly, the apertures 195 and 95A, and 195A and 95A thereof, are positioned in space relation one to the other thereby defining a pair of substantially coaxially aligned apertures 335 and 336 which are operable to accommodate the bit 23.

Figure 4:
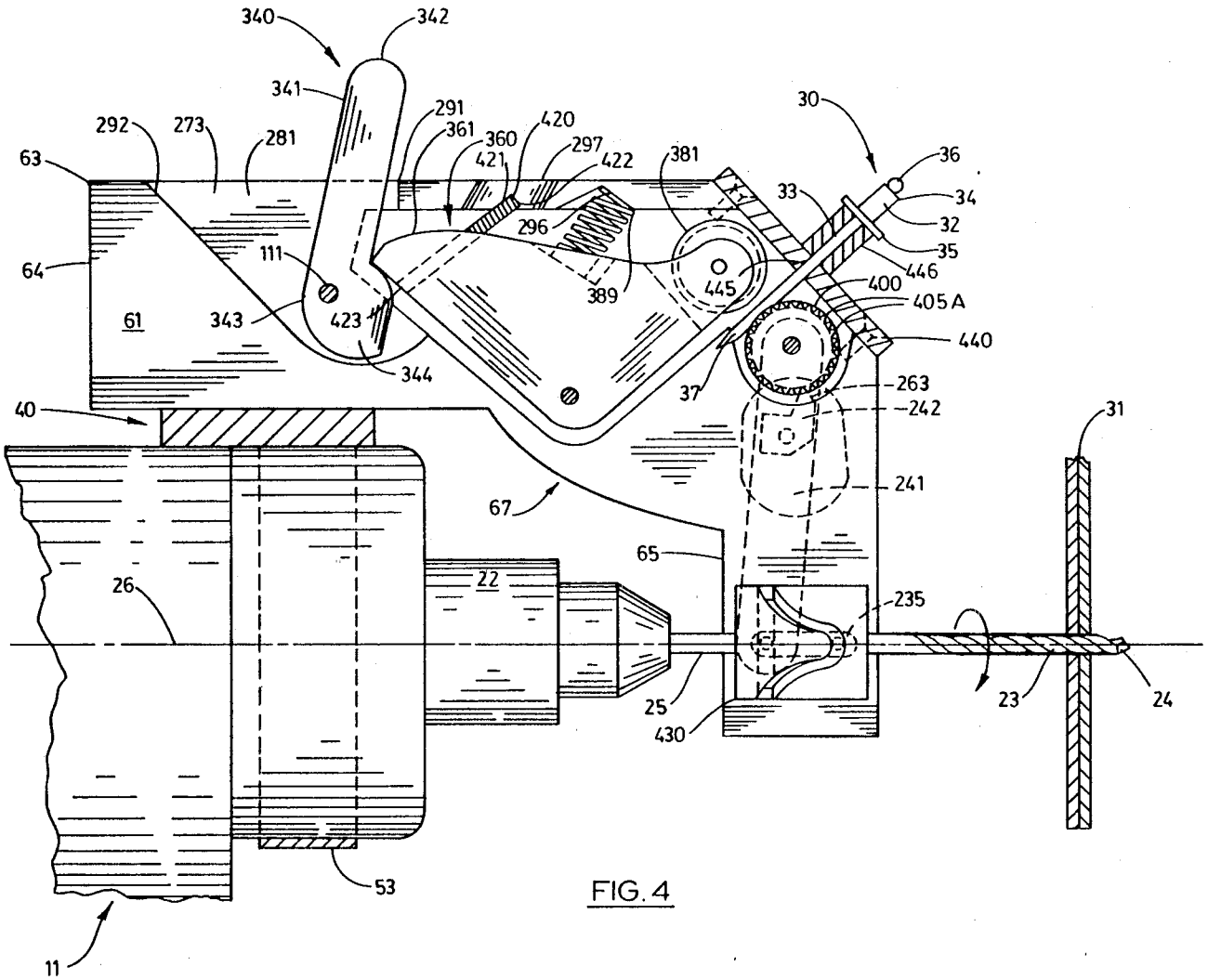
FIG. 4 is a left fragmentary, longitudinal, vertical, sectional view taken from a position along line 4—4 of FIG. 1, and which illustrates the apparatus of the present invention being employed to form an aperture in two juxtapositioned working surfaces.

As best depicted by a study of FIGS. 3, 4 and 5, a locking assembly, and which is generally indicated by the numeral 340, is defined by a main body 341 having a first end 342 and an opposite second end 343 which defines a cam member, or engagement surface 344. The first end 342 forms a hand manipulatable member or handle which permits an operator (not shown) to manually actuate the locking assembly during the use thereof. The main body is further defined by a left lateral surface 345, a right lateral surface 346 and a peripheal edge or surface 347. The second end 343 has an aperture 347 formed therein. When assembled, the pin 111 is inserted and received through the aperture 103 of the right housing portion 62, the aperture 347 of the locking lever main body, and the aperture 203 of the left housing portion 61, thereby appropriately positioning the locking assembly for pivotal movement within the locking lever cavity 273. The main body of the locking lever has a thickness dimension which is generally less than the width dimension of the locking lever cavity 273, and therefore, it should be understood that the locking assembly 340 is operable for pivotal movement, about the pin 111, and within the locking lever cavity as discussed above. In particular, the locking lever is operable to be manually manipulated by an operator in a reciprocal fashion from a first, unlocked position, wherein the first end of the locking assembly is positioned at the first end 291 of the locking lever cavity, to a second, locked position, and wherein the first end 342 is positioned at the second end 292 of the locking lever cavity. In addition to the foregoing, it should be understood that, upon movement of the locking assembly from the first to the second positions, the cam member 344 is operable to forcibly engage the riveting assembly in a predetermined fashion which will be described in further detail hereinafter.

As best illustrated in FIGS. 3, 4, and 5, a riveting assembly and which is generally indicated by the numeral 360, is defined by a main body 361 which has a first end 362, an opposite second end 363, a top portion 364 and an opposite bottom portion 365. The main body is further defined by a left lateral surface 366, a right lateral surface 367 and a peripheal surface 368. The bottom portion 365 has an aperture 369 formed therein. When assembled, the pin 112 is inserted and received through the aperture 104 of the right housing portion 62, the aperture 369 of the main body 361, and the aperture 204 of the left housing portion 61 thereby pivotally positioning or otherwise mounting the riveting assembly within the riveting cavity 274. The main body of the riveting assembly has a thickness dimension which is generally less than the width dimension of the riveting assembly cavity 274 when the housing is assembled, and therefore, it should be understood that the riveting assembly 360 is operable for pivotal movement as discussed above, about the pin 112. More particularly, and as noted earlier, the riveting assembly is positioned in the riveting cavity in such fashion whereby it is disposed in force receiving relation relative to the locking assembly 340. As should be understood, the cam member 344 of the locking assembly is operable to forcibly engage the first end 362 of the riveting assembly main body thereby driving the riveting assembly in a predetermined direction along a path of travel, and otherwise impeding the movement of the riveting assembly along the same path of travel in the opposite direction. In particular, the riveting assembly is operable for movement from a first, unlocked position, wherein the second end 363 of the riveting assembly is positioned in a location substantially away from the drive wheel cavity 275, to a second, locked position, wherein the second end of the riveting assembly is positioned in a location substantially adjacent to the drive wheel cavity. In this regard, the locking assembly is operable to impede the movement of the riveting assembly when it is moving towards the first unlocked position, and is operable to drive or otherwise forcibly propel the riveting assembly toward the second locked position.

As should be understood, and formed on the second end 363 of the main body 361, are a pair of ears 371 which extend generally longitudinally outwardly therefrom, and which have individual, substantially coaxially aligned apertures 372 formed therein. A pin 373 is operable to be received in the coaxially aligned apertures 372. A pressure wheel 381 is rotatably borne by the riveting assembly. The pressure wheel 381 is defined by a left lateral surface 382, a right lateral surface 383, and a peripheral surface 384. A circumferentially disposed groove 385 is formed in the peripheal surface and is conformably dimensioned to receive the mandrel 33. Further, the pressure wheel has an axial bore 386 formed therein. When assembled, the pin 373 is inserted through the coaxially aligned apertures 372, and the axial bore 386, respectively, thereby rotatably mounting the pressure wheel 381 on the second end 363 of the riveting assembly. The operation of the pressure wheel will be discussed in greater detail hereinafter.

In addition to the foregoing, and as best illustrated by FIGS. 3 and 6, formed in the top portion 364 of the peripheal surface 368, of the main body 361, is a threaded aperture 387; and a spring receiving station, or depression 388 which is operable to support one end of a spring 389. As best seen by reference to FIG. 4, the spring is biased between the cavity 296 and spring receiving station. The threaded aperture 387 is operable to receive a threaded shaft or fastener and which operates as an adjustment assembly. This will be described below. As best seen by a comparative study of FIGS. 4 and 5, and during operation, the spring 389 imparts a biasing force to the riveting assembly 360 thereby driving the riveting assembly to the first, unlocked position. As discussed above, the locking assembly impedes the motion of the riveting assembly when it is moving towards the first, unlocked position. Further, and when the first end 342 of the locking lever 34 is moved to the second locked position, the cam member 344 imparts a motive force to the first end 362 of the riveting assembly thereby driving the second end 363 of the riveting assembly into the second, locked position adjacent to the drive wheel cavity. This motion places the spring 389 into compression. Therefore, and when the locking lever is moved to the first unlocked position, the compressed spring 389 drives the riveting assembly into the first, unlocked position, thereby moving the second end 363 and the pressure wheel 381 away from the drive wheel cavity and into the unlocked position.

As best seen by reference to FIG. 3, a drive wheel and which is generally indicated by the numeral 400, is rotatably borne by the housing 60 and is defined by a main body 401 which has a left lateral surface 402, a right lateral surface 403, and a peripheral surface 404. The peripheral surface has formed therein a first substantially circumferentially disposed ratchet portion 405 which is defined by a plurality of teeth 405A, and a second substantially circumferentially disposed grooved portion 406. The grooved portion is conformably dimensioned to mate or otherwise cooperate with the pressure wheel 381 thereby receiving the mandrel 33 of the rivet 30. In particular, and as can best be seen by a comparative study of FIG. 3 and 5, for example, it should be understood that the grooved portion 406 and the groove 385 formed in the pressure wheel, are substantially aligned, when assembled, such that when the riveting assembly is moved to the second, locked position, the pressure wheel is operable to hold or otherwise urge or press the mandrel into frictional receiving relationship relative to the drive wheel. The drive wheel has an axial bore 407 formed therein. When assembled, the pin 113 is inserted and received through the bore 255 of the drive arm 241; the bore 236, which is formed in the left housing portion 61; the axial bore 407 of the drive wheel; and the bore 105 of the right housing 62, respectively. As earlier discussed, the pawl 242 extends from the inner drive cavity portion 227 and into the drive wheel cavity 275 where it forcibly engages the circumferentially disposed ratchet portion 405 of the drive wheel. In operation, the ratchet portion urges the drive wheel in a predetermined counter-clockwise rotational path of travel as viewed from FIG. 4 upon reciprocal movement of the drive arm 241. In particular, it should be recognized that upon movement of the drive arm in a direction towards the rear of the housing 60, the pawl is caused to rotate about the pin 257 in a clockwise fashion whereby the spring 272 is placed into compression, and to such a position whereby the tooth 263 of the pawl can move or slide by one tooth of the drive wheel and into engagement with the adjoining tooth or teeth of the ratchet portion. Further, and when the drive arm moves in a direction toward the forward portion of the housing 60, the spring 272 maintains the position of the pawl thereby causing the pawl to forcibly engage the drive wheel and urge it to rotate in the counter-clockwise rotation as that is viewed in FIG. 4, for example. In addition to the foregoing, a predetermined distance is defined by the location of the pressure wheel with respect to the drive wheel. More particularly, and when the riveting assembly is disposed in the locked position, a first distance is defined between the grooved portion 406 of the drive wheel 400 and the groove 385 of the pressure wheel 381. This first distance is just slightly less than the diametral dimension of the mandrel such that the pressure wheel can hold or otherwise press the mandrel into frictional receiving engagement with the drive wheel. Moreover, and when the riveting assembly is disposed in the unlocked position, a second distance is defined which is substantially greater than the first distance, and which permits the apparatus 10 to receive a rivet for installation.

As best illustrated by a study of FIGS. 3, 4 and 5, and as earlier discussed, the apparatus 10 of the subject invention includes an adjustment assembly which is illustrated as a threaded shaft or fastener 420, and which has a main body 421 which includes opposite first and second ends 422 and 423, respectively. The main body 421 is conformably dimensioned to screwthreadably engage the threaded bore 387. It should be understood that the adjustment assembly is operable to vary the first and second distances between the drive wheel and the pivot wheel thereby permitting the apparatus 10 to install a variety of rivets which may individually have mandrels 33 of varying diametral or cross-sectional dimensions. This is accomplished when the threaded fastener is advanced through the threaded bore 387 such that the second 423 extends outwardly and may be engaged by the locking assembly. An operator (not shown) accesses the adjustment assembly 420 through the aperture 297. As should be understood, screwthreadable rotation of the adjustment assembly in a clockwise direction threadably advances and extends the second end of the fastener, and counter-clockwise rotation retracts the fastener within the threaded aperture 387.

As best seen by a study of FIGS. 3, 4 and 5, a spindle or bit engagement member 430 is received in the spindle support structure 325 and more particularly is supported for rotational movement on the arcuately or semi-circular shaped surfaces 328. The spindle 430 is generally circular in its overall cross-sectional configuration. However, the main body 431 of the spindle has a substantially centrally or axially disposed and hexagonally shaped aperture 432 which has a cross-sectional dimension which is just slightly greater than the cross-sectional dimension of the shaft portion 25 of the bit 23. As should be understood, the shaft portion of the bit is received in the aperture 432 and thereby engages the spindle. Therefore, the bit is rendered operable to impart rotational movement to the spindle. The spindle 430 has an exterior facing surface 433 which has an undulating channel 434 formed therein. As should be understood, and when disposed in the spindle support structure 325, the post or actuator 261 of the drive arm 241 is received in the undulating channel. In operation, and as rotational movement is imparted to the spindle by means of the bit 23, the drive arm 241 is caused to pivot in a reciprocal fashion about the pin 113. This reciprocal motion is further imparted to the pawl 242 which is operable, as earlier discussed, to cause the tooth 263 of the pawl to repeatedly and forcibly engage the ratchet portion 405 of the drive wheel in a fashion whereby the drive wheel rotates in a counter-clockwise direction as that is viewed from FIG. 4.

As best illustrated by reference to FIGS. 1, 2 and 3, the apparatus 10 of the subject invention includes a rivet support assembly which is generally indicated by the numeral 440. The rivet support assembly 440 is defined by a main body 441 which has a generally rectangular shape, and which includes an outwardly facing surface 442 and an opposite inwardly facing surface 443. Formed in predetermined locations in the main body 441 are a plurality of apertures 444 which are operable to receive the threaded fasteners 94. When assembled, the threaded fasteners 94 are inserted through the apertures 444 and screw threadably engage each pair of apertures 193 and 93, respectively, thereby mounting the rivet support assembly to the angularly disposed surfaces 173 and 73, respectively. As should be understood, the main body 441 has a substantially centrally disposed bore 445 formed therein. Further, a support member 446 is mounted on the outwardly facing surface 442. The support member is defined by a main body 447 which has a bore 448 formed therein and which is coaxially aligned with the bore 445. The bore 448 is conformably dimensioned to receive the mandrel of a pop rivet 30. As should be understood, the rivet support assembly 440 is operable to fixedly locate the rivet 30 in a work surface engagement position during the installation process of same. As should be understood, the rivet support assembly may be replaced from time-to-time to accommodate rivets having mandrels of different cross-sectional or diametral dimensions.

OPERATION

The operation of the described embodiment of the present invention is believed to be readily apparent and is briefly summarized at this point.

As best seen by FIGS. 3, 4 and 5, the apparatus 10 of the subject invention is operable to install a pop-rivet or blind rivet 30 having a hollow rivet body and a mandrel. The apparatus 10 is releasably mounted on, or otherwise borne by a power drill 11 having a drill bit 23. The drill may be energized by any suitable power source including hydraulic, pneumatic or electricity. The apparatus 10 includes a housing 60 which defines an internal operating cavity 67 and which is operable to support the rivet 30. A driving assembly 240 is borne by the housing and is disposed in force receiving relation relative to the drill bit. As earlier discussed, the apparatus 10 further includes a locking assembly 340, which is also borne by the housing, and which is operable to move along a predetermined path of travel from the first, unlocked position, to a second, locked position. In addition to the foregoing, a riveting assembly 360 is positioned in the internal operating cavity 67 and is disposed in force receiving relation relative to the locking assembly and the driving assembly, respectively. As earlier discussed, the riveting assembly engages the mandrel 33 of the rivet body when the locking assembly is positioned in the second locked position. Following rotation of the drill bit, the riveting assembly, by way of the driving assembly, forcibly withdraws the mandrel from the rivet body until the mandrel separates from the rivet body thereby completing the riveting process.

As discussed earlier, the housing 60 of the apparatus 10 mounts for rotatable movement a spindle or bit engagement member 430 which is disposed in the internal operating cavity of the housing, and which includes a substantially cylindrical main body having an exterior surface which has formed therein an undulating and substantially continuous groove. The bit engagement member is operable to receive the bit, and rotation of the bit causes a corresponding rotation of the bit engagement member. The apparatus 10 further includes a movable drive arm 241 which is borne by the housing, and which is operable to engage the undulating groove formed in the bit engagement member. It should be understood that rotation of the bit engagement member imparts reciprocating motion to one end of the drive arm.

The apparatus 10, and more particularly the housing 60, encloses a drive wheel 400 which is disposed in the internal operating cavity 67 of the housing 60 and which includes a circumferentially disposed ratchet portion; and a circumferentially disposed grooved portion which is operable to engage the stem portion 37 of the mandrel 33. A pawl 242 is borne by the drive arm 240 and is operable to engage the ratchet portion 405 of the drive wheel. In operation, and as discussed earlier, the reciprocating motion of the drive arm causes the pawl to rotate the drive wheel in a counter-clockwise direction as that is viewed from FIG. 4.

The riveting assembly 360 includes a pivotally mounted main body 341 which is borne by the housing 60. The pivotly mounted main body mounts a pressure wheel 381 which includes a peripheral surface 384 which has formed therein a circumferentially disposed groove 385 which is operable to engage the stem portion 37 of the mandrel 33. Furthermore the housing encloses a pivotally mounted locking assembly 340 which has opposite first and second ends 341, and 342 and wherein the first end is manually manipulated by an operator, and the second is disposed in force transmitting relation relative to the first end 362 of the main body 341. During operation, the locking lever is operable to move along a predetermined path of travel from a first, unlocked position to a second locked position. As should be understood and following insertion of the mandrel into the bore 448 of the rivet support assembly 440, the first end of the locking lever is moved by the operator to the second, locked position thereby pivoting the main body 341, and urging the pressure wheel towards the drive wheel. When this event occurs, movement of the pressure wheel towards the drive wheel positions or otherwise presses or holds the stem of the mandrel in frictional, or force receiving relation relative to the drive wheel. Thereafter, and following rotation of the bit, reciprocal motion is imparted to the drive arm thereby causing the pawl to rotate the drive wheel in the counter-clockwise direction, whereby the drive wheel imparts frictional force to the stem thereby withdrawing the mandrel from the hollow rivet body until the mandrel separates from the hollow rivet body which completes the riveting process.

Therefore, the apparatus 10 of the subject invention can be employed in a wide variety of operative environments and can be manufactured and purchased at a nominal cost when compared with related prior art devices. As a general matter, the apparatus is efficient in operation, and is compact, thereby facilitating its utilization and maintenance, and is further designed in a fashion whereby it reduces to an absolute minimum the assorted problems associated with other prior art devices which are designed for substantially identical purposes.

Although the present invention has been herein shown and described in what is conceived to be the most practical and preferred embodiment, it is recognized that the departures may be made therefrom within the scope of the invention which is not to be limited to the illustrated details disclosed.

What I claim as new and desire to secure by Letters Patent of the United States is:

1. A fastening apparatus for installing a rivet which includes a hollow rivet body and a mandrel, the apparatus comprising:

a means for imparting rotational movement to a drill bit;

a housing borne by the rotation means and which includes an internal operating cavity, and which is operable to support the rivet;

a driving assembly borne by the housing and disposed in force receiving relation relative to the drill bit;

a locking assembly borne by the housing and which is operable to move along a predetermined path of travel from a first unlocked position to a second locked position; and a riveting assembly positioned in the internal cavity and disposed in force receiving relation relative to the locking assembly, and wherein the riveting assembly engages the mandrel of the rivet body when the locking assembly is positioned in the second locked position, and wherein rotation of the drill bit causes the riveting assembly, in combination with the driving assembly, to forcibly withdraw the mandrel from the rivet body until the mandrel separates from the rivet body thereby completing the riveting process.

2. A fastening apparatus, as claimed in claim 1, and wherein the rotatable drill bit includes a work surface engagement portion, and an opposite shaft portion which is matingly engaged by the driving assembly.

3. A fastening apparatus, as claimed in claim 2, and wherein the driving assembly includes a bit engagement member which is rotatably mounted in the internal operating cavity and which includes a substantially cylindrical main body having internal and external facing surfaces, and wherein the internal facing surface defines a channel of predetermined dimensions which is operable to matingly receive the shaft portion of the bit, and wherein the external surface has formed therein an undulating and substantially continuous groove, and wherein rotation of the bit causes a corresponding rotation of the bit engagement member.

4. A fastening apparatus, as claimed in claim 3, and wherein the driving assembly includes a movable drive arm which is borne by the housing and which includes opposite first and second ends, and wherein the second end is operable to engage the undulating groove formed in the bit engagement member, and wherein rotation of the bit engagement member imparts reciprocating motion to the second end of the drive arm.

5. A fastening apparatus, as claimed in claim 4, and wherein the driving assembly further includes a drive wheel which is rotatably borne on the housing and disposed in the internal operating cavity and which includes a peripheral surface, and a centrally disposed bore, and wherein the peripheral surface has formed therein a first ratchet portion, and a second circumferentially disposed grooved portion which is operable to engage the mandrel of the rivet.

6. A fastening apparatus, as claimed in claim 5, and wherein the driving assembly further includes a pawl borne by the drive arm and which is engageable with the ratchet portion of the drive wheel and wherein reciprocating motion of the drive arm causes the pawl to rotate the drive wheel in a predetermined direction.

7. A fastening apparatus, as claimed in claim 6, and wherein the riveting assembly includes a pivotally mounted support member which has opposite first and second ends, and wherein a pressure wheel is rotatably borne on the second end of the support member and includes a peripheral surface and a centrally disposed bore, and wherein the peripheral surface has formed therein a circumferentially disposed groove which is operable to engage with the mandrel of the rivet when the locking assembly is moved from the first, unlocked position to the second locked position.

8. A fastening apparatus, as claimed in claim 7, and wherein the locking assembly includes a pivotally mounted locking lever which is borne by the housing, and which includes opposite first and second ends, and wherein the first end is manually manipulated by an operator, and the second end forcibly engages the first end of the support member.

9. A fastening apparatus for installing a rivet which includes a hollow rivet body and a mandrel, the apparatus comprising:

means for imparting rotational movement to a drill bit;

a housing releasably borne by the rotation means and which includes a longitudinal line of reference and an internal operating cavity, and wherein the housing supports the hollow rivet body, and includes an aperture having a predetermined dimension which is operable to receive the mandrel of the rivet;

a bit engagement member rotatably mounted in the internal operating cavity and which includes a substantially cylindrical main body having internal and external facing surfaces, and wherein the internal facing surface defines a channel of predetermined dimensions which is operable to matingly receive the bit, and wherein the external facing surface has formed therein an undulating and substantially continuous groove, and wherein rotation of the bit causes a corresponding rotation of the bit engagement member;

a driving assembly borne by the housing and disposed in force receiving relation relative to the bit engagement member, and wherein the driving assembly is operable for reciprocating motion along a predetermined path of travel which is substantially parallel to the longitudinal line of reference;

a locking assembly borne by the housing and operable to move along a predetermined path of travel from a first unlocked position to a second locked position; and a riveting assembly disposed in the internal cavity and positioned in force receiving relation relative to the locking assembly, and wherein the mandrel of the rivet is inserted into the housing aperture, and the riveting assembly engages the mandrel of the rivet when the locking assembly is positioned in the second locked position, and wherein upon rotation of the bit reciprocal motion is imparted to the driving assembly whereby the riveting assembly, in combination with the driving assembly, is operable to forcibly withdraw the mandrel from the rivet body until the mandrel separates from the hollow rivet body which thereby completes the riveting process.

10. A fastening apparatus, as claimed in claim 9, and wherein the driving assembly includes a movable drive arm which is borne by the housing, and which includes opposite first and second ends, and wherein the second end is operable to engage the undulating groove formed in the bit engagement member, and wherein rotation of the bit engagement member imparts reciprocating motion to the second end of the drive arm.

11. A fastening apparatus, as claimed in claim 10, and wherein the driving assembly further includes a drive wheel which is rotatably borne by the housing and disposed in the internal operating cavity and which includes a peripheral surface and a centrally disposed bore, and wherein the peripheral surface has formed therein a first circumferentially disposed ratchet portion, and a second circumferentially disposed grooved portion which is operable to engage the mandrel of the rivet.

12. A fastening apparatus, as claimed in claim 11 and wherein the driving assembly further includes a pawl which is borne by the drive arm and which is engageable with the ratchet portion of the drive wheel, and wherein reciprocating motion of the drive arm, causes the pawl to rotate the drive wheel in a predetermined direction.

13. A fastening apparatus, as claimed in claim 12, and wherein the riveting assembly includes a pivotally mounted support member which includes opposite first and second ends, and wherein a pressure wheel is rotatably borne on the second end of the support member and which includes a peripheral surface, and a centrally disposed bore, and wherein the peripheral surface has a circumferentially disposed grooved portion formed therein which is operable to engage the mandrel of the rivet.

14. A fastening apparatus, as claimed in claim 13, and wherein the locking assembly includes a pivotally mounted locking lever having opposite first and second ends, and wherein the first end is manually manipulated by an operator, and the second end of the locking lever forcibly engages the first end of the support member.

15. A fastening apparatus for installing individual rivets which include a hollow main body, and a mandrel, and wherein the mandrel includes a head portion and an opposite stem portion, the apparatus comprising:

a means for imparting rotational movement to a drill bit which includes a work surface engagement portion and an opposite shaft portion;

a housing releasably borne by the rotation means and having a longitudinal line of reference and an internal operating cavity, and wherein the housing supports the hollow main body, and includes an aperture which receives the mandrel;

a bit engagement member rotatably mounted in the internal operating cavity and which includes a substantially cylindrical main body having internal and external facing surfaces, and wherein the internal facing surface defines a channel of predetermined dimensions which is operable to matingly receive the shaft portion of the drill bit, and wherein the external surface has formed therein an undulating and substantially continuous groove, and wherein rotation of the bit causes a corresponding rotation of the bit engagement member;

a movable drive arm borne by the housing and which includes opposite first and second ends, and wherein the second end is operable to engage the undulating groove formed in the bit engagement member, and wherein rotation of the bit engagement member imparts reciprocating motion to the second end of the drive arm;

a drive wheel rotatably borne on the housing and disposed in the internal operative cavity and which includes a peripheral surface which has formed therein a first circumferentially disposed ratchet portion and a second circumferentially disposed grooved portion which is operable to engage the stem portion of the mandrel;

a pawl borne by the drive arm and which engages the ratchet portion of the drive wheel, and wherein reciprocating motion of the drive arm causes the pawl to rotate the drive wheel in a predetermined direction;

a pivotally mounted support member borne by the housing and disposed in the internal operating cavity, the support member having opposite first and second ends;

a pressure wheel rotatably borne on the second end of the support member and which includes a peripheral surface which has formed therein a circumferentially disposed grooved portion which is operable to engage the stem portion of the mandrel; and a pivotally mounted locking lever borne by the housing and which includes opposite first and second ends, and wherein the first end is manually manipulated by an operator, and the second end is disposed in force transmitting relation relative to the first end of the support member, and wherein the locking lever is operable to move along a predetermined path of travel from a first unlocked position to a second locked position and wherein following insertion of the mandrel into the aperture, the first end of the locking lever is moved by the operator to the second locked position thereby pivoting the support member and urging the pressure wheel towards the drive wheel, and wherein the movement of the pressure wheel towards the drive wheel positions or otherwise presses the stem of the mandrel into force receiving relation relative to the drive wheel, and wherein upon rotation of the bit, reciprocal motion is imparted to the drive arm thereby causing the pawl to rotate the drive wheel in a predetermined direction whereby the drive wheel imparts frictional force to the stem, and wherein the frictional force withdraws the mandrel from the hollow rivet body until the mandrel separates from the hollow rivet body which thereby completes the riveting process.

16. A fastening apparatus, as claimed in claim 15, and wherein the pivotally mounted support member includes an adjustment assembly which is mounted on the first end of the support member, and wherein the adjustment assembly permits the apparatus to accommodate rivets having stems with varying outside diametral dimensions.

17. A fastening apparatus, as claimed in claim 1 and wherein a biasing means is mounted on the support member and disposed in a predetermined position to bias the support member in a direction away from the drive wheel.

* * * * *